US005933884A

United States Patent [19]

Shikinami et al.

[11] Patent Number: 5,933,884

[45] Date of Patent: Aug. 10, 1999

[54] METHOD OF MOVING HORIZONTALLY RESTING SUBJECT

[75] Inventors: Hiroko Shikinami; Shigeru Onishi, both of Kanazawa, Japan

[73] Assignee: Nippon Clean Engine Research Institute Co., Ltd., Kanazawa, Japan

[21] Appl. No.: 08/973,004

[22] PCT Filed: Apr. 10, 1997

[86] PCT No.: PCT/JP97/01251

§ 371 Date: Dec. 1, 1997

§ 102(e) Date: Dec. 1, 1997

[87] PCT Pub. No.: WO97/38659

PCT Pub. Date: Oct. 23, 1997

[30] Foreign Application Priority Data

| | | | |
|---|---|---|---|
| Apr. 12, 1996 | [JP] | Japan | 8-126247 |
| Feb. 8, 1997 | [JP] | Japan | 9-61690 |

[51] Int. Cl.[6] ..... A61G 7/10

[52] U.S. Cl. ..... 5/81.1 HS; 5/81.17; 5/86.1

[58] Field of Search ..... 5/81.1 R, 81.1 HS, 5/81.1 T, 86.1, 484, 487, 502

[56] References Cited

U.S. PATENT DOCUMENTS

| | | | |
|---|---|---|---|
| 3,284,816 | 11/1966 | Laubsch | 5/81.1 T |
| 3,769,642 | 11/1973 | Warman | 5/81.1 T |
| 4,012,799 | 3/1977 | Rutherford | 5/81.1 R |
| 4,051,565 | 10/1977 | Berge | 5/81.1 R |
| 4,944,053 | 7/1990 | Smith | 5/502 X |
| 5,148,558 | 9/1992 | Dunn | 5/81.1 T |

FOREIGN PATENT DOCUMENTS

| | | |
|---|---|---|
| U-53-108195 | 8/1978 | Japan . |
| A-5-31142 | 2/1993 | Japan . |
| A-6-269477 | 9/1994 | Japan . |

*Primary Examiner*—Michael Trettel
*Attorney, Agent, or Firm*—Oliff & Berridge, PLC

[57] ABSTRACT

A flexible sheet is inserted under a care-receiver lying horizontally on a stationary bed. Next, one edge of the flexible sheet is wrapped around a drawing rod. The rod with the edge of the flexible sheet wrapped on it is manually pulled forward to move the care-receiver to a movable bed.

11 Claims, 7 Drawing Sheets

METHOD OF MOVING HORIZONTALLY RESTING SUBJECT

TECHNICAL FIELD

The present invention relates to a technique for the care and benefit of the physically impaired, more particularly relates to a method for movement of a horizontally resting subject.

BACKGROUND ART

Moving a seriously physically impaired care-receiver resting horizontally on a bed to another location for treatment or a mental break requires the entire body of the care-receiver to be lifted up or the upper part of the body to be held and the lower part of the body to be pulled off to move the care-receiver to a wheelchair etc. When moving a care-receiver in this way, it is heavy labor for the care-giver to remain upright. Accordingly, this task is considerably hard for the elderly or less strong women.

On the other hand, recently, lifting devices for lifting up and moving care-receivers have been developed. These lifting devices, however, are not only high in price, but also force an unnatural posture on the care-receivers when lifting Therefore, these lifting devices cannot be said to be preferable.

DISCLOSURE OF THE INVENTION

The present invention was made in consideration of these current circumstances and has as its object the provision of a method of moving a care-receiver enabling even less strong care-giver to independently and easily perform the task of moving a care-receiver so important and essential to care.

According to the present invention, there is provided a method of moving a horizontally resting subject comprising inserting a flexible sheet under the horizontally resting subject, wrapping one edge of the flexible sheet around a pulling rod, and manually pulling the rod with the edge of the flexible sheet wrapped around it so as to move the horizontally resting subject.

BRIEF DESCRIPTION OF THE DRAWINGS

The invention will be described with reference to the Figures, in which.

BEST MODE FOR WORKING THE INVENTION

Figure 1:
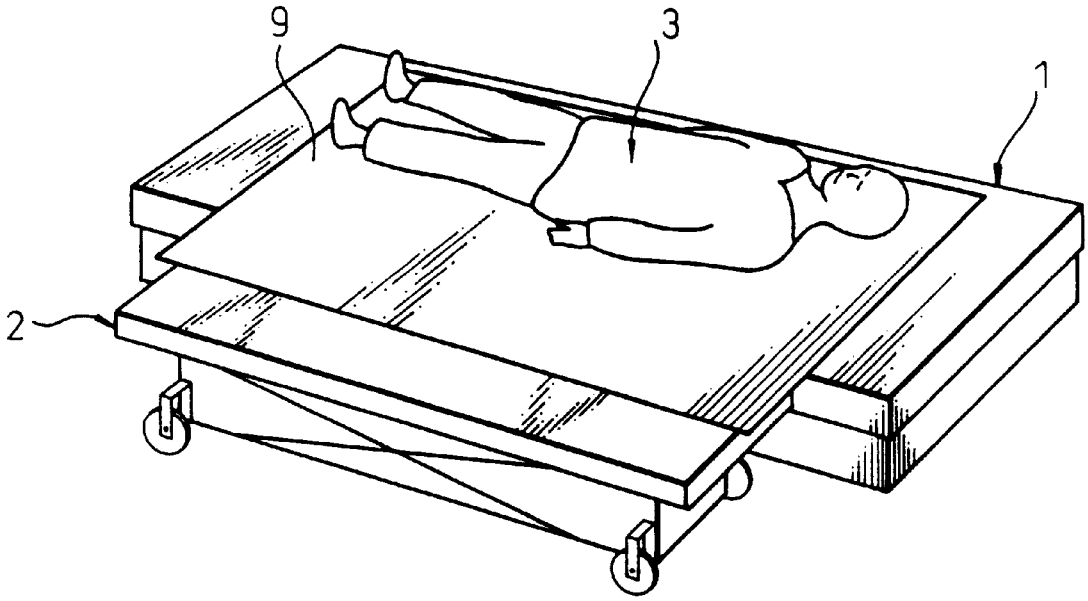
FIG. 1 is a perspective view of a bed.
Figure 2:
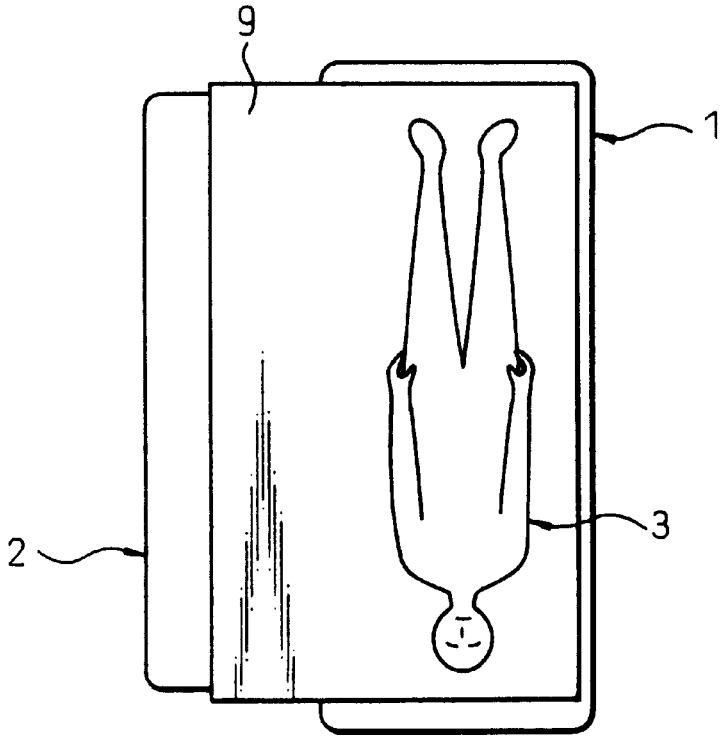
FIG. 2 is a plan view of the bed.
Figure 3:
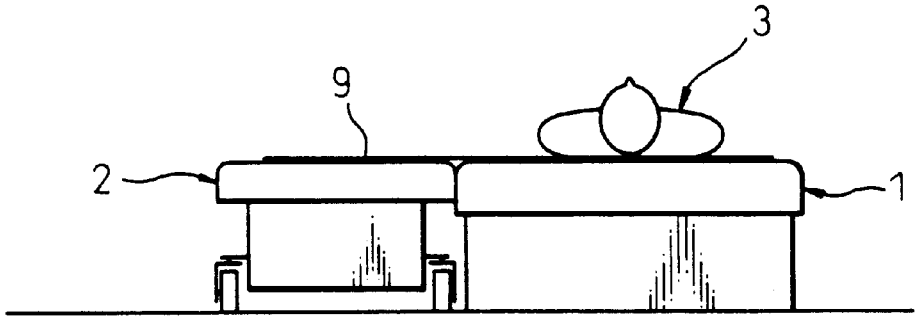
FIG. 3 is a side view of the bed.
Figure 4:
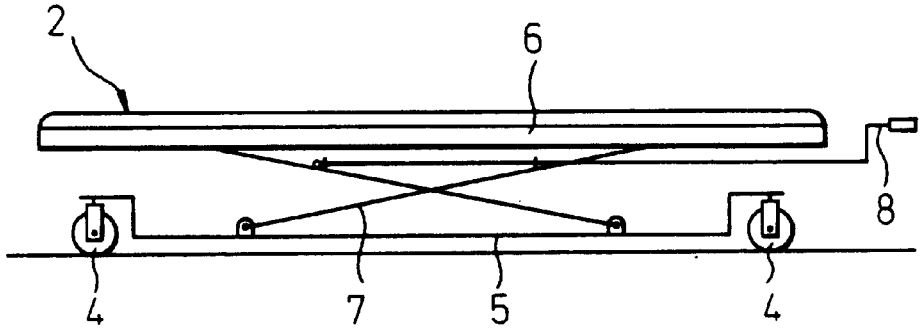
FIG. 4 is a side view of a movable bed shown schematically.

Referring to FIG. 1 to FIG. 3, 1 is a stationary bed, 2 is a movable bed, and 3 is a care-receiver lying horizontally on the stationary bed 1. The movable bed 2, as shown in FIG. 4, is provided with a frame 5 provided with rollers 4, a pantograph mechanism 7 pivotally attached to the frame 5 and able to slide in the longitudinal direction along the bottom surface of a bed board 6, and a rotary lever 8 for moving the pantograph mechanism 7 up and down and can be adjusted in height by turning the rotary lever 8.

Figure 5:
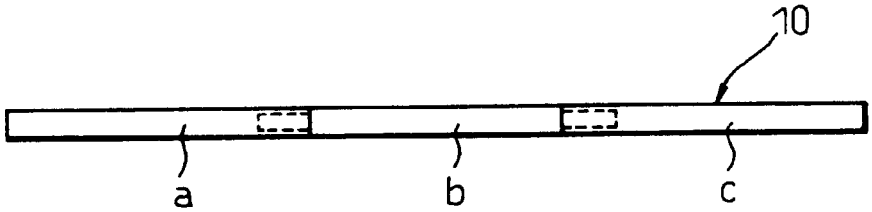
FIG. 5 is a side view of a rod.

In the method of moving a care-receiver 3 according to the present invention, as the tools for moving the care-receiver 3, the flexible sheet 9 shown in FIG. 1 to FIG. 3 and the pulling rod 10 shown in FIG. 5 are used. In the embodiment shown in FIG. 1 to FIG. 3, the sheet 9 is rectangular in shape. The longitudinal span of the sheet 9 is formed to a dimension somewhat longer than the standard height of an adult and the lateral span of the sheet 9 to a dimension considerably larger than the standard lateral span of an adult.

Further, the sheet 9 is formed from a smooth fabric or plastic material with a low frictional resistance. In the embodiment shown from FIG. 1 to FIG. 3, the sheet 9 is comprised of low density polyethylene. The sheet 9 may also be formed in whole or part from a mesh-like structure. Further, the sheet 9 may be formed to be porous in whole or part so improve the air ability. Further, the sheet 9 may be printed on its surface with graphics, letters, etc. using a pigment or ink with an antibacterial property. Further, an antibacterial substance may be added to the material of the sheet 9 itself.

On the other hand, the pulling rod 10 is comprised of a hollow cylinder made of a plastic material. The rod 10 has a length substantially the same as the longitudinal span of the sheet 9. In the embodiment shown in FIG. 5, the rod 10 is comprised of three rod portions a, b, and c for convenience in carrying and storage. The rod is assembled by inserting the two ends of the rod b into the ends of the rods a and c.

Next, the method of moving a care-receiver according to the present invention will be explained taking as an example the case of moving a care-receiver from a stationary bed 1 to a movable bed 2.

First, a movable bed 2 adjusted to substantially the same height as the stationary bed 1 is moved close to the stationary bed 1. Next, the care-giver inserts the flexible sheet 9 under the care-receiver 3. The sheet 9 can be inserted under the care-receiver 3 very simply by the same method as when changing a bed sheet. For example, the sheet 9 may be inserted under the care-receiver 3 by rolling the care-receiver 3 lying face upward over to his or her side, spreading the sheet 9 at the portion where the back of the care-receiver 3 had originally been, then returning the care-receiver 3 to his or her original position.

Figure 6:
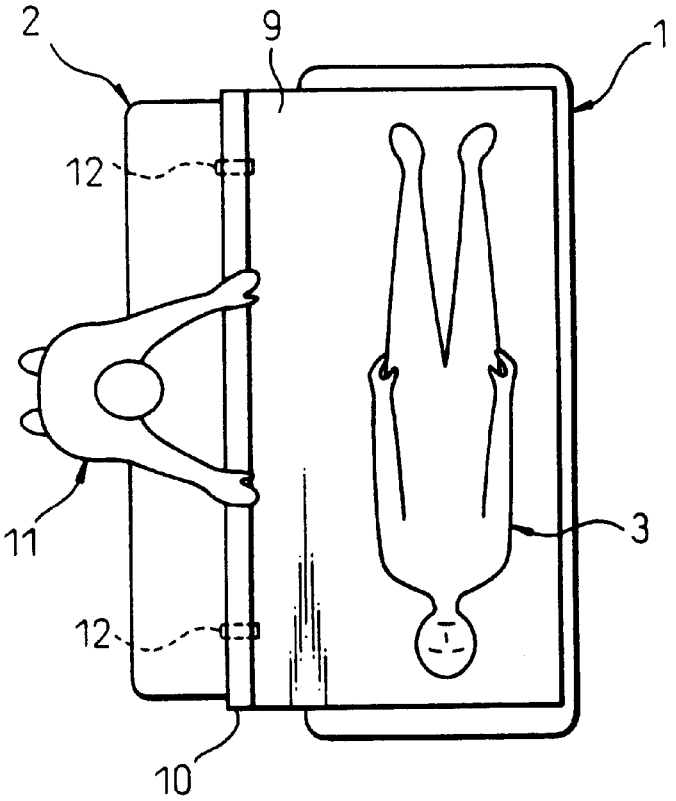
FIG. 6 is a plan view of a bed.
Figure 7:
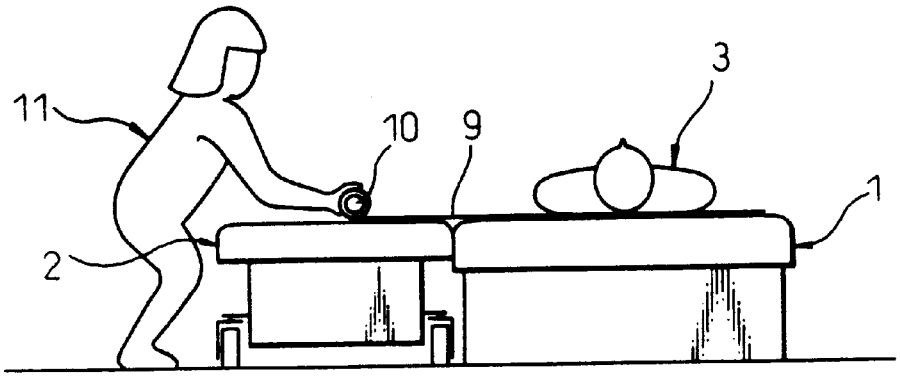
FIG. 7 is a side view of a bed.
Figure 8:
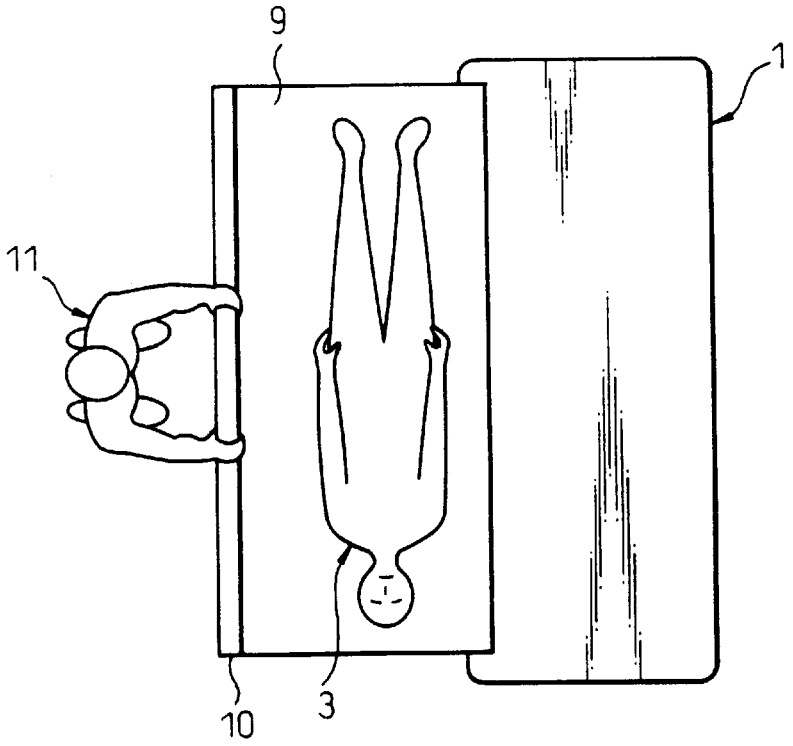
FIG. 8 is a plan view of a bed.
Figure 9:
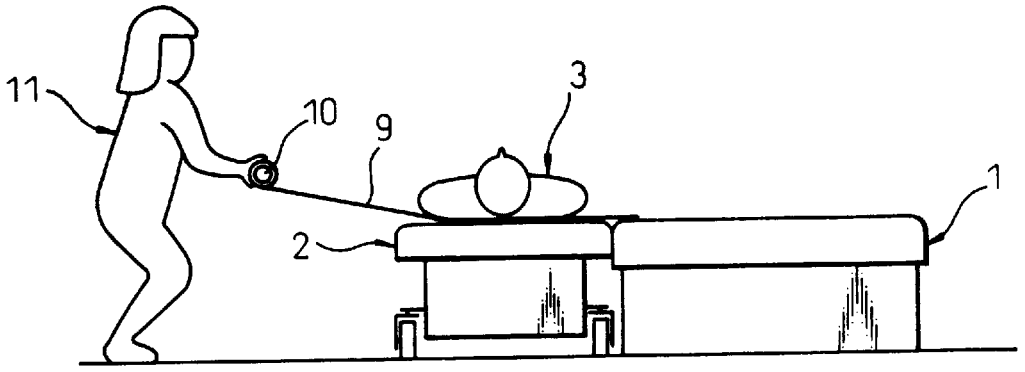
FIG. 9 is a side view of a bed.

Next, the movable bed 2 is moved right next to the stationary bed 1 and one edge of the sheet 9 is spread on the movable bed 2. This state is shown in FIG. 1 to FIG. 3. Next, as shown in FIG. 6 and FIG. 7, the care-giver 11 wraps one edge of the sheet 9 around the rod 10. Next, in accordance with need, sheet holding clips 12 are attached around the sheet 9 wrapped around the rod 10. Next, the care-giver 11 holds the middle part of the rod 10 and pulls the rod 10 toward himself or herself to move the sheet until the care-receiver 3 is positioned on the movable bed 2 as shown in FIGS. 8 and 9.

When using the rod 10 to pull the sheet 9 in this way, no unreasonable force is exerted on the care-receiver 3 during the movement. The care-receiver 3 is moved from the stationary bed 1 to the movable bed 2 in the same position. Therefore, there is almost no pain or load on the care-receiver 3 at the time of movement. On the other hand, the frictional resistance between the sheet 9 and the stationary bed 1 and the frictional resistance between the sheet 9 and the movable bed 2 are extremely small, therefore the sheet 9 can be pulled even with a very small force.

When the care-receiver 3 is moved on the movable bed 2, the care-giver 11 pulls the sheet 9 from under the care-receiver 3. At this time as well, the sheet 9 can be easily pulled out by a similar method as when pulling out a regular bed sheet.

Figure 10:
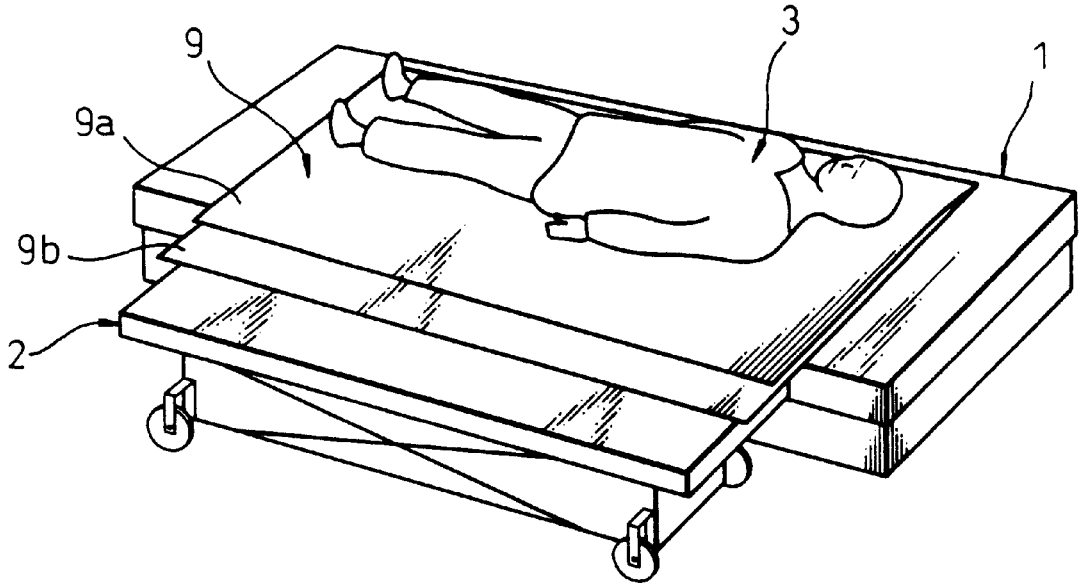
FIG. 10 is a perspective view of a bed.

FIG. 10 shows another embodiment. In this embodiment, the sheet 9 is folded into two and then inserted under the care-receiver 3, Next, one side of the upper sheet 9*a* is wrapped around the rod 10 (not shown), then the rod 10 and the upper sheet 9*a* are pulled forward by the care-giver. At this time, the upper sheet 9*a* slides over the lower sheet 9*b*. The frictional resistance between the upper sheet 9*a* and the lower sheet 9*b* is smaller than the frictional resistance with the beds 1 and 2, therefore in this embodiment, the care-receiver 3 can be moved with even less of a pulling force.

Figure 11:
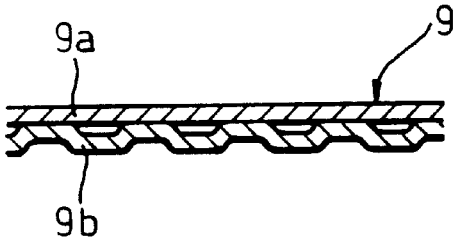
FIG. 11 is a cross-sectional view of a sheet.
Figure 12:
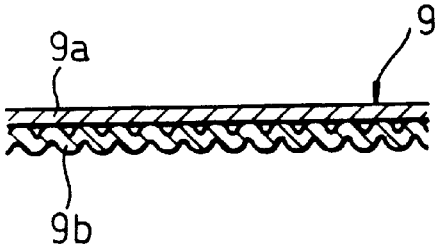
FIG. 12 is a cross-sectional view of another embodiment of a sheet.
Figure 13:
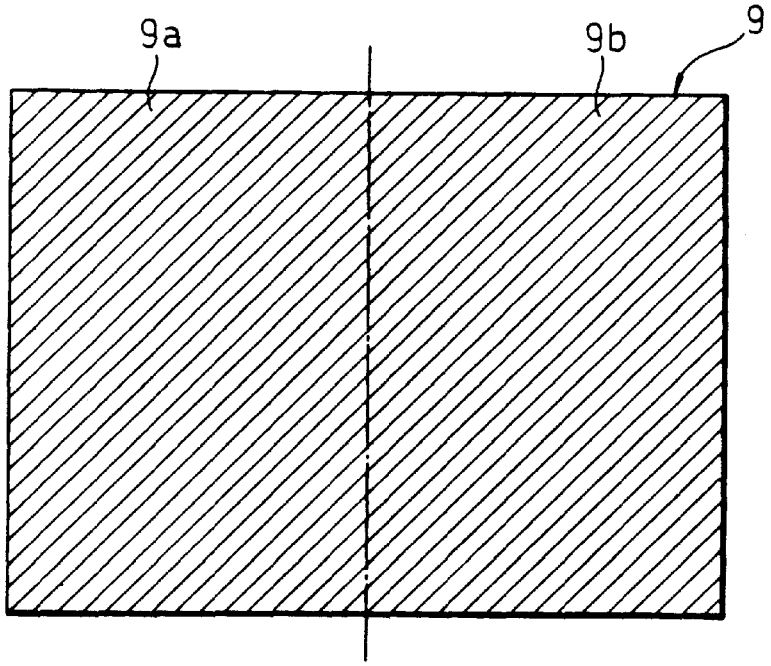
FIG. 13 is a plan view of still another embodiment of a sheet.

FIG. 11 to FIG. 13 show various embodiments which enable the upper sheet 9*a* to be pulled with even less force. In the embodiment shown in FIG. 11, the upper sheet 9*a* is formed smooth, while the lower sheet 9*b* is formed with a large number of equally spaced ridges. Further, in the embodiment shown in FIG. 12, the upper sheet 9*a* is formed smooth, while the lower sheet 9*b* is formed with a wave-like cross-section. Further, in the embodiment shown in FIG. 13, the entire surface of the sheet 9 is formed with a wave-like cross-section with wave-like ridges extending at an angle with respect to the longitudinal direction or lateral direction of the sheet 9. This sheet 9 is used folded along the broken line.

Note that the upper sheet 9*a* and the lower sheet 9*b* in FIG. 10 may be formed from separate sheets. Further, in this case, the upper sheet 9*a* and the lower sheet 9*b* may be respectively given the shapes shown in FIG. 11 and FIG. 12.

Figure 14:
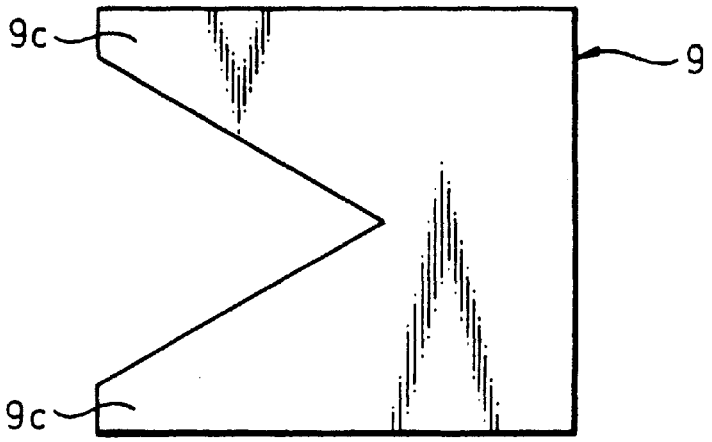
FIG. 14 is a plan view of still another embodiment of a sheet.

FIG. 14 shows still another embodiment. In this embodiment, the sheet 9 is provided with a pair of arm portions 9*c* extending outward from one edge of the rectangular sheet portion. In this embodiment, one of the arm portions 9*c* is slipped under the neck portion of the care-receiver, the other arm portion 9*c* is slipped under the knee portion of the care-receiver, and then the front ends of the arm portions 9*c* are pulled to insert the rectangular sheet portion of the sheet 9 under the care-receiver. Next, the front ends of the arm portions 9*c* are wrapped around the rod 10 (not shown) and the rod 10 pulled forward to move the care-receiver.

Figure 15:
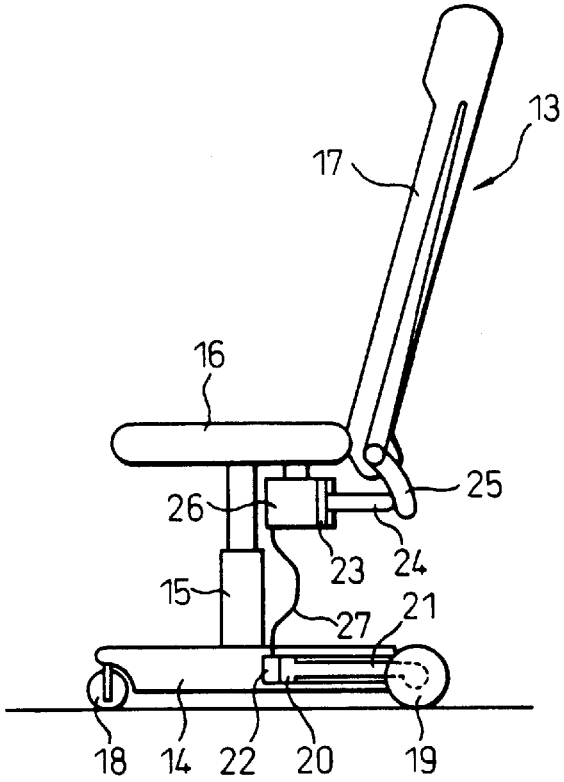
FIG. 15 is a side view of a dual use chair-movable bed shown schematically.
Figure 16:
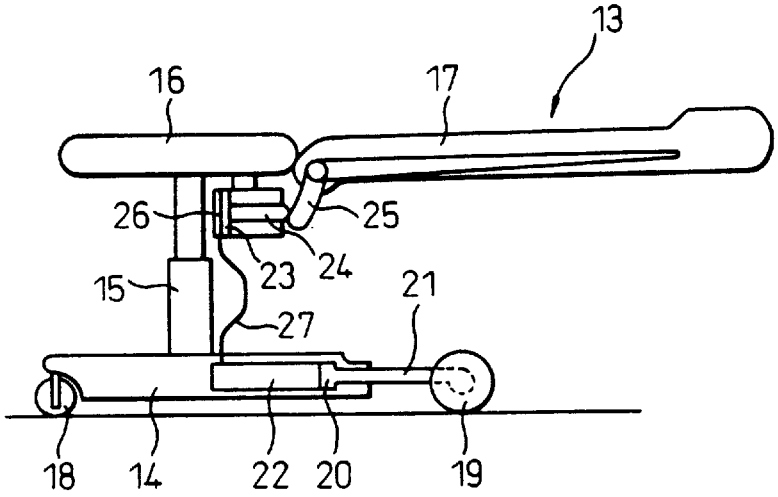
FIG. 16 is a side view of the dual use chair-movable bed shown schematically.

FIG. 15 and FIG. 16 show a dual use chair-movable bed 13 which may be used in place of the movable bed 2 shown in FIG. 4. Note that FIG. 15 shows the state where it is used as a chair, while FIG. 16 shows the state where it is used as a bed. Referring to FIG. 15 and FIG. 16, 14 is a frame, 15 is an extendable support attached to the frame 14, 16 is a seat portion supported by the top of the support 15, 17 is a seat back attached pivotably to an edge of the seat portion 16, 18 is a front roller, and 19 is a rear roller. A piston 20 is inserted movably in the horizontal direction in the frame 1. The rear roller 19 is attached to the front end of a piston rod 21. This piston rod 21 is constantly biased toward the inside of an oil-filled cylinder chamber 22 by the spring force of a not shown spring.

On the other hand, an arm 25 abutting against a piston rod 24 of a piston 23 is affixed to the bottom end of the seat back portion 17. The cylinder chamber 26 of the piston 23 is communicated with the inside of the cylinder chamber 22 through a flexible tube 27. This cylinder chamber 26 is also filled with oil. When the seat back portion 17 is pushed down from the state shown in FIG. 15 to the state shown in FIG. 16, the oil in the cylinder chamber 26 is supplied to the inside of the cylinder chamber 22. As a result, the piston rod 21 is pushed out, so the rear roller 19 moves to the rear. Therefore, when the dual use chair-movable bed 13 is used as a bed, a good stability is obtained.

As opposed to this, when the seat back portion 17 is returned from the state shown in FIG. 16 to the state shown in FIG. 15, the piston rod 21 retracts due to the spring force and the rear roller 19 returns to the retracted position shown in FIG. 15. Therefore, when the dual use chair-movable bed is used as a chair, the rear roller 19 does not get in the way.

To move the care-receiver onto the dual use chair-movable bed 13, first the movable bed 13 is placed in the state shown in FIG. 16 and the sheet 9 used to move the care-receiver from the stationary bed 1 to the movable bed 13. Next, as shown in FIG. 15, the seat back 17 is raised, whereby the care-receiver ends up seated in a chair.

According to the present invention, it is possible for even a less strong care-giver to independently, safely, and reliably perform the task of moving a care-receiver.

We claim:

1. A method of moving a horizontally resting subject comprising steps of:

inserting a flexible sheet under the horizontally resting subject, the sheet having a longitudinal dimension longer than a height of an average man;

assembling a pulling rod where the pulling rod can be divided into a plurality of rod portions;

wrapping one edge of the flexible sheet around the pulling rod, the pulling rod having a length equal to the longitudinal dimension of the sheet; and manually pulling forward the pulling rod with the edge of the flexible sheet wrapped around the pulling rod so as to move the horizontally resting subject.

2. A method of moving a horizontally resting subject as set forth in claim 1, wherein said sheet is comprised of a plastic material having a low coefficient of friction to facilitate the pulling step.

3. A method of moving a horizontally resting subject as set forth in claim 1, wherein said sheet is comprised of a double-layer sheet of an upper sheet and a lower sheet, one edge of the upper sheet is wrapped around the rod, and the upper sheet slides over the lower sheet when the rod is manually pulled forward.

4. A method of moving a horizontally resting subject as set forth in claim 3, wherein the lower sheet is formed with a wave-like cross-section to have a lower coefficient of friction to facilitate the pulling step.

5. A method of moving a horizontally resting subject as set forth in claim 3, wherein the upper sheet and the lower sheet are formed with a wave-like cross-section to have a lower coefficient of friction to facilitate the pulling step.

6. A method of moving a horizontally resting subject as set forth in claim 3, further comprising a step of folding said sheet into two to make the double-layer sheet of the upper sheet and lower sheet prior to the inserting step.

7. A method of moving a horizontally resting subject as set forth in claim 1, wherein said sheet is comprised of a rectangularly shaped sheet portion and a pair of arm portions extending outward from one edge of the rectangularly shaped sheet portion and in the step of wrapping one edge, the front ends of the arm portions are wrapped around the rod and constitute the one edge.

8. A method of moving a horizontally resting subject as set forth in claim 1, wherein a care-receiver lies on a first bed and the sheet and rod are used to move the care-receiver from the first bed to a second bed of substantially the same height as the first bed.

9. A method of moving a horizontally resting subject as set forth in claim 8, wherein the second bed is a movable bed which can be adjusted in height.

10. A method of moving a horizontally resting subject as set forth in claim 9, wherein said movable bed also functions as a chair and is provided with a front roller, a rear roller, and a seat back portion able to be pushed down substantially horizontally and the rear roller is moved backward when the seat back portion is pushed down substantially horizontally, further comprising a step of pushing down the back portion to establish a horizontal movable bed prior to the inserting step.

11. A method of moving a horizontally resting subject as set forth in claim 1, further comprising a step of attaching sheet holding clips over the sheet wrapped around the pulling rod.

* * * * *